US005865221A

United States Patent [19]

Ludwig et al.

[11] Patent Number: 5,865,221

[45] Date of Patent: Feb. 2, 1999

[54] VALVE FOR FILLING LIQUIDS INTO PACKAGES

[75] Inventors: Werner Ludwig, Darmstadt; Eberhard Sendobry, Rimbach; Michael Wolf, Gross-Umstadt, all of Germany

[73] Assignee: Tetra Laval Holdings & Finance S.A., Switzerland

[21] Appl. No.: 716,425

[22] PCT Filed: Mar. 7, 1995

[86] PCT No.: PCT/EP95/00838

§ 371 Date: Sep. 20, 1996

§ 102(e) Date: Sep. 20, 1996

[87] PCT Pub. No.: WO95/26906

PCT Pub. Date: Oct. 12, 1995

[30] Foreign Application Priority Data

Apr. 2, 1994 [DE] Germany ..... 44 11 629.2

[51] Int. Cl.[6] ..... B65B 1/04; B65B 3/04; B65B 31/00; B67C 3/00

[52] U.S. Cl. ..... 141/31; 141/89; 141/90; 141/91; 141/115; 141/116; 239/567; 239/590

[58] Field of Search ..... 141/31, 89, 90, 141/91, 115, 116, 392; 239/567, 590, 590.3, 590.5, 600

[56] References Cited

U.S. PATENT DOCUMENTS

| | | | |
|---|---|---|---|
| 2,893,646 | 7/1959 | Batts | 239/567 |
| 4,579,156 | 4/1986 | Graffin | 141/89 |
| 4,958,669 | 9/1990 | Ohta | 141/31 |
| 5,094,278 | 3/1992 | Arao et al. | 141/31 |
| 5,562,129 | 10/1996 | Graffin | 141/90 |

FOREIGN PATENT DOCUMENTS

| | | |
|---|---|---|
| 2601421 | 3/1977 | Germany . |
| 3212089 | 10/1983 | Germany . |
| 2841198 | 10/1986 | Germany . |

*Primary Examiner*—Henry J. Recla
*Assistant Examiner*—Timothy L. Maust
*Attorney, Agent, or Firm*—Killworth, Gottman, Hagan & Schaeff, L.L.P.

[57] ABSTRACT

A valve for filling liquids into packages has a housing (1) with a supply connection piece (24), a forward mouth piece and an outlet device (16) in which a large number of outlet holes (4) is arranged. A closing member (3) is movably arranged in the housing (1), and can be engaged with a valve seat (23). Rear sealing devices (5, 7, 22) are also provided. In order to make possible a high volume flow of the liquid contents at low outlet speed without relative movement occurring between the package and outlet device (16) it is provided that the outlet holes (4) distributed over the whole cross-section of the mouth piece (2) are arranged in an outlet plate (16) which is configured integrally with the mouthpiece, and penetrate it in the direction (26) of the longitudinal axis (28) of the mouth piece, that the diameter and the width of the outlet holes (4) is larger than 1 mm and smaller than 5 mm, and that the length of the outlet holes (4) is greater than double their diameter and their width.

10 Claims, 5 Drawing Sheets

VALVE FOR FILLING LIQUIDS INTO PACKAGES

Figure 1:
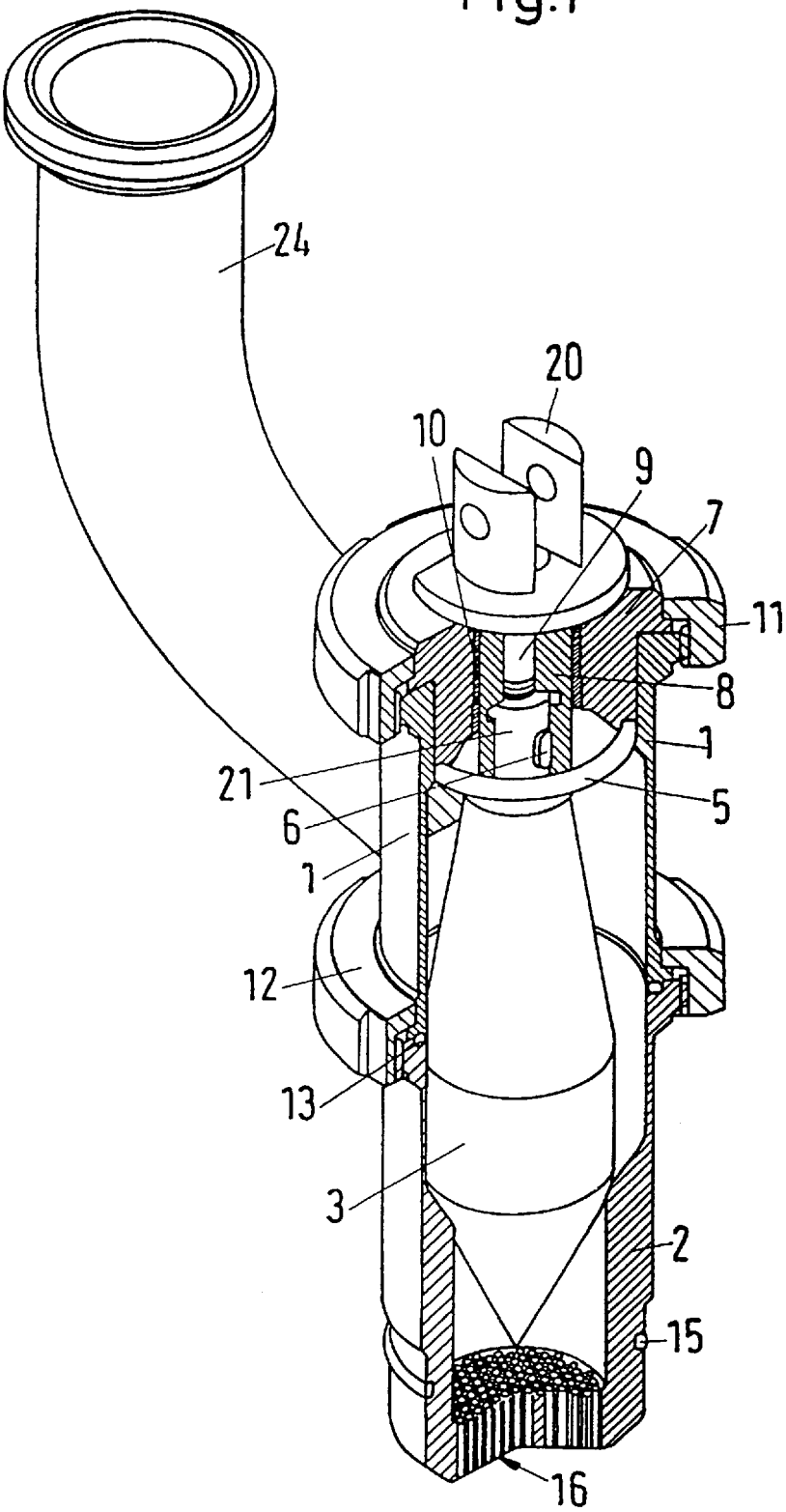

The invention relates to a valve for filling liquids into packages, with a housing with a supply connection piece, a forward mouthpiece and an outlet device in which a large number of outlet holes is arranged, with a closing body movably arranged in the housing which can be engaged with a valve seat, and sealing devices at the rear.

In practice, various methods and suitable filler mouth pieces and filler valves for them are known for filling containers or packages with liquid foodstuffs. In the most commonly used methods, with very short filling times, a mouth piece is dipped into package to be filled and into the product which has already been put in it. In this way, despite a high production rate, foaming or spraying of the product is avoided. Dripping of the product is normally prevented by means of one or more sieves in the mouth piece so that the surface tension of the product in the sieve holds the weight of the product in the mouth piece. In addition, flexible mouth pieces, for example made from silicon, are known which are closed by means of a low pressure produced in the filler pipe.

When the mouth piece is dipped into the container and when filling is carried out above the level of the product, the filling rate has to be slowed down for highly foaming products, such as milk or the like, in order to limit the formation of foam. The dipping of the filler mouth piece into the product to be filled, and the contact with the inside of the container or the container opening by parts of the filler is undesirable for reasons of hygiene. The dipping of the filler mouth piece in the container is not desirable from an economic point of view, as an additional movement is needed for doing this. Either the container or package has to be lifted, or the filler mouth piece has to be lowered into the container.

In the case of packages with small in-fill openings, the diameter of the in-fill opening limits the diameter of the filler mouth piece and that of the filler pipe. In order to obtain a high volume flow, the flow speed of the product must be increased. This, however, leads to increased foam formation when foamy products are filled in.

Furthermore, filler mouth pieces used in practical operation are usually difficult to clean, as they normally have to be disassembled and cleaned by hand.

It would therefore be desirable to avoid the dipping of filler parts or parts of a filler valve in the container or the package during filling, and to fill the product into the package with a free stream. Several problems would arise with this, however. According to the height of the drop, the product to be filled would be accelerated by gravity, so that with very highly foaming products the filling speed would have to be reduced, which would result, disadvantageously, in a lengthening of the filling time and thereby a reduction in machine capacity.

The object of the invention is therefore to improve a filler valve with the features previously described so that a high volume flow of the liquid filling product with low outlet speed is made possible without relative movement between the package and outlet device.

According to the invention, this object is solved in that the outlet holes distributed over the whole surface of the mouthpiece are arranged in an outlet plate, and penetrate it in the direction of the longitudinal axis of the mouth piece, said outlet plate being configured integrally with the mouthpiece, that the diameter and the width of the outlet holes is greater than 1 mm and less than 5 mm, and that the length of the outlet holes is greater than double their diameter and their width. It has been shown that when the features of this solution according to the invention are taken into consideration, it is possible for liquid products to be filled into a package at a low outlet speed in sufficient quantity when the distance apart between the outlet plate with the outlet holes described and the filler opening in the package remains constant during the filling operation.

This is mainly the result of the configuration of the outlet plate, which is configured integrally with the mouth piece. In practice, the outlet plate forms the forward, outlet side terminal portion of the mouth piece and is perpendicular to its longitudinal axis. The outlet holes, in the shape of short tubes or rather of bores, penetrate the outlet plate perpendicularly, so that they run in the direction of the longitudinal axis of the mouth piece, preferably all parallel to one another and particularly preferably are linear.

If the size of the diameter and width of the outlet holes, and the ratio thereof to their length which substantially corresponds to the thickness of the outlet plate, is taken into account a high volume flow of the liquid product to be filled can be obtained without too much foam formation in the package, as the outlet speed of the product to be filled is less compared to conventional filler valves.

Dripping of the product is advantageously avoided as the product to be filled is held back in the space above the outlet plate, on the one hand by the atmospheric pressure and on the other hand by the surface tension of the liquid. However, where it is possible to put a high volume flow in the in-fill opening of the package, despite a lower outlet speed of the product to be filled compared to known valves, as is the case with the invention, the filling time is in this way advantageously reduced. Tests with the valve according to the invention have proved that in comparison to a conventional valve, the filling time using the same outlet cross-section and with the same foam formation can be reduced by approximately 25%.

In a further advantageous embodiment of the invention, the cross-section of the outlet holes is made circular. Although the advantages previously described can also be obtained with outlet holes with an oval, elongated, arched or similar configuration, the circular shape is particularly easy to manufacture (bores).

When, in another alternative according to the invention, the cross-section of the outlet holes is shaped as a polygon, between the individual outlet holes there always remains a web, which with modern operating methods, for example when the mouth piece and outlet plate is manufactured from, for example, stainless steel or aluminium, can be kept very narrow. The width of the webs between adjacent polygonal outlet holes, for example, hexagonal holes, can be between 0.1 and 0.5 mm, preferably approximately 0.3 mm. In this way even better use is made of the surface, as the cross-section of the outflow side of the mouth piece corresponds approximately to the cross-section of the outlet plate that can be provided with outlet holes. Attempts are made to arrange the outlet holes distributed over the whole cross-section(of the mouth piece, that is to say over the projection of the cross-section of the mouth piece down onto the outlet plate. Embodiments show that the surface of the material of the outlet plate remaining between the outlet holes is less in the case of polygonal outlet holes than in the case of circular holes.

It is furthermore advantageous according to the invention when the downstream external surface of the outlet plate is concave. If the so-called active surface of the outlet plate, that is to say the surface in which the outlet holes are arranged, is designed in such a manner that the surface facing the inside of the mouth piece is planar, and the downstream external surface of the outlet plate mentioned is slightly concave, when the valve is opened and the liquid product to be filled in initially flows out, spraying of small splashes onto the surface of the package outside its in-fill opening are avoided. During operation, the filler valve is intermittently opened and closed. Even when dripping is avoided, it cannot be avoided that liquid is retained on the external, downstream surface of the outlet plate due to cohesion. It is also thrown off at a slight angle of, for example 5° to 10°, in the form of small splashes, by repeated opening of the filler valve. However, according to the invention, with the curvature these splashes are concentrated on the surface inside the in-fill opening of the package, or in other words are focused.

The "concave" curvature of the external surface of the outlet plate described is the curvature wherein the central area of the outlet plate curves counter to the direction of the flow, inwards towards the inside of the mouth piece. In other words, the centre of a circle of this concave curvature lies on the outflow side outside the mouthpiece on the extension of its central longitudinal axis, and preferably below it, as the filler valve is generally arranged so that the central longitudinal axis of the mouthpiece is horizontal, so that the outlet plate is horizontal. In other words, the outlet holes of the outlet plate are shorter in the middle area by up to 5% to 30%, preferably by up to 10% to 25%.

It is also advantageous according to the invention, when the closing member is shaped on the outflow side as a cone, the cone angle of which ($\gamma$) is in the region of 40° to 90°, preferably 60° to 70°. The design of the closing member at the outflow end in combination with the outlet plate results in the production of a compact filling stream, whereby in particular with the outlet holes closely arranged next to one another, mixing-in of air even during the precipitation of the product to be filled in is excluded. Because of the configuration of the cone in the manner according to the invention, the product to be filled can be carefully transported through the valve. It is particularly advantageous when the closing member is configured without sharp edges, with gentle blending with a slight curve from its outflow-side forward end to the upstream rear end, and advantageous from the point of view of flow technology, as it is known in the case of under-water bodies, except that in the case of the invention the product to be filled in flows around the closing A body from the rear to the front. When the product to be filled finally arrives in the area around the cone, the stream is then advantageously calmed at this point, and no clearance volumes with wakes are produced, with the result that the flow of the product to be filled is regular and neat individual streams form which leave the outlet plate at the outflow end.

After leaving, preferably below the outlet plate, the individual streams of liquid leaving the outlet holes combine through cohesion into a common stream. The diameter of this common stream is advantageously less than the external diameter of the cross-section through which the large number of individual streams flow.

The latter relates to the so-called active surface of the outlet plate, which when the measures according to the invention are taken into account can, in an unexpected manner, be kept slightly larger (for example 5 to 10% larger) than the cross-section of the in-fill opening of the package. Care must be taken only that the cross-section of the combined stream brought together from the individual streams fits into the in-fill opening of the package.

The previously described advantages are obtained even more advantageously when according to the invention the distance of the tip of the cone of the closing body from the outflow side internal surface of the outlet plate is greater than half the diameter of the mouth piece. Reference is again made to the mouth piece, as its cross-section, or its diameter or width corresponds to the active surface in the outlet plate. The formation of small eddies directly at the tip of the cone often cannot be avoided during operation when the valve is open. When the distance of the tip of the cone from the outlet plate is taken into account in the sense previously described, that is to say the distance selected is not too small, the flowing liquid is given the possibility of flowing away under the outlet plate at a regular speed, so that the individual streams can join together there in the previously described and advantageous manner. Eddies and other turbulence are therefore avoided advantageously in the area of the outlet plate.

The invention is advantageously further configured so that the mouth piece is kept releasably inserted in a matchingly shaped recess in a carrier plate by means of seals so that essentially only the external surface of the outlet plate facing downstream and the external surface of the mouth piece in the area around the outlet plate projects from the carrier plate into the hygienic space. Both in normal operation during filling-in of liquid foodstuffs and in particular in sterile and aseptic operation it is advantageous to employ all means to ensure that contamination cannot occur. According to the invention it is possible, by means of the measures described herein, for the filler valve to be immersed only to a very small extent in the hygienic area. With this there are also only small surfaces which, by projecting, reach into the hygienic space or the aseptic area of such a machine. If there are only small surfaces, then there is almost no condensation, or only a negligible amount can condense and contaminate the product to be filled in by dripping. There is also only a small surface which could be contaminated with splashes from the product to be filled in. Insertion also simplifies the construction and assembly of the valve. Clamping or fastening parts such as, for example, screws, are undesirable in a hygienic space. By means of the measures according to the invention, gaps which are difficult to clean are excluded.

It is also further advantageous according to the invention when a cleaning cap is arranged in a guiding device mounted in the carrier plate, which has a sealing surface with sealing means facing the carrier plate, wherein the sealing surface of the cleaning cap is configured to match the corresponding surfaces of the carrier plate and those of the mouth piece projecting from it, to contain and to form an internal cleaning space. By means of these measures, the filler valve according to the invention can be cleaned particularly well in situ and also sterilized in situ. Only the closing body and the cleaning cap together with its guide are moveable parts, which can move into the hygienic space or where appropriate into the aseptic space. Known filler valves have many moveable parts and therefore large surface areas with the disadvantages this involves. The cleaning cap only needs to be moved for cleaning and sterilising, otherwise with the new filler valve there is only the closing member which moves into the hygienic space, which is configured with an appropriately smooth and closed surface, and is kept sealed on the valve side, so that contamination is prevented, germs cannot develop and bacteria cannot be imported in from the valve. The few passages are sealed so that bacteria cannot be drawn into the hygienic space. Lubrication points are omitted with the valve according to the invention.

The one-piece configuration of the outlet plate and the mouth piece assists easy cleaning. The previously used sieves, screens or inserts which had to be suitably sealed onto the mouthpiece and made cleaning and servicing difficult are no longer needed. By inserting the valve in the carrier plate, and retention by means of the seals, length changes of the housing and/or mouth piece caused by temperature variations during cleaning can be accommodated and compensated for.

The cleaning of the new filler valve can be done daily and in situ. The surfaces of the cleaning cap on the one hand, and of the carrier plate with the projecting mouth piece on the other hand are configured projecting into the hygienic space so that cleaning in situ, and where appropriate also sterilization prior to starting operations, can be undertaken in a simple manner.

The outlet holes can be produced either by boring, or in the case of polygonal cross-sections by erosion with a laser beam or water jet or the like. The active surface of the outlet plate can be optimally employed, as there are only small areas of material remaining between the outlet holes, so that a sufficient number of individual streams of the liquid to be filled in can be allowed through by the outlet plate and a high volume flow can be provided despite having a low outlet speed.

Figure 2:
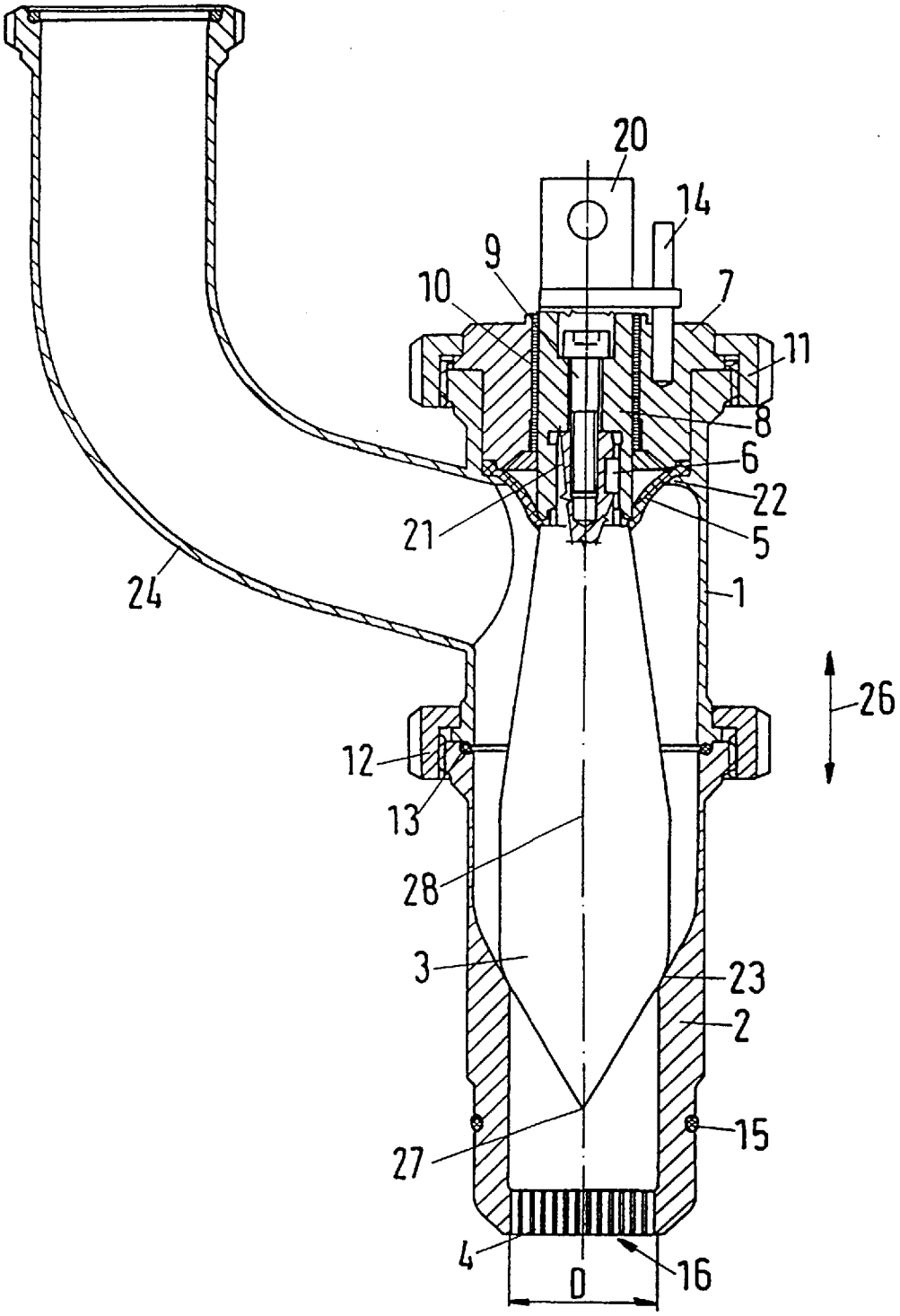
Figure 3:
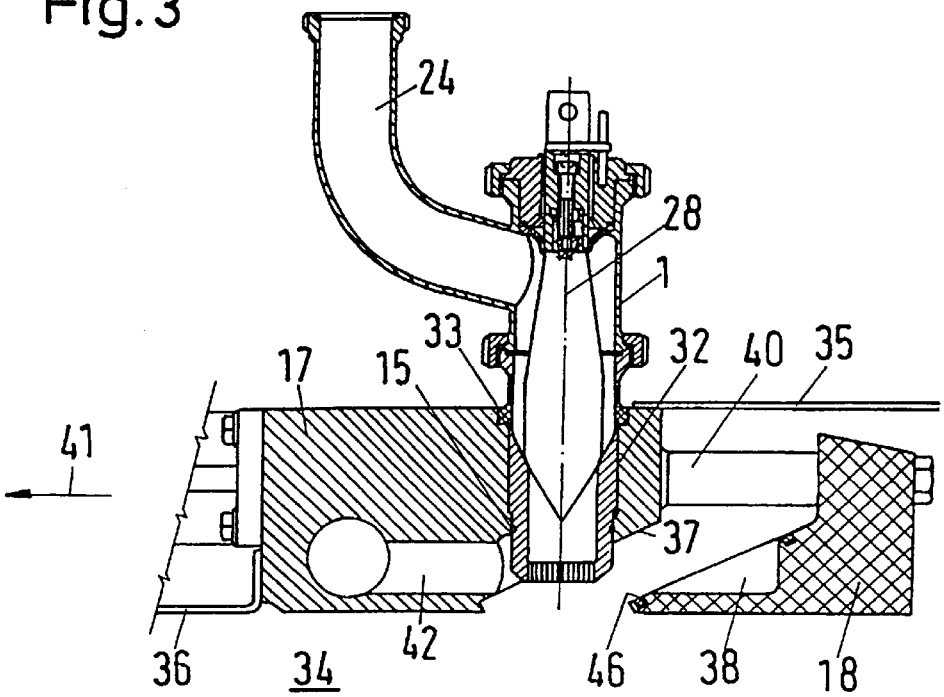
Figure 4:
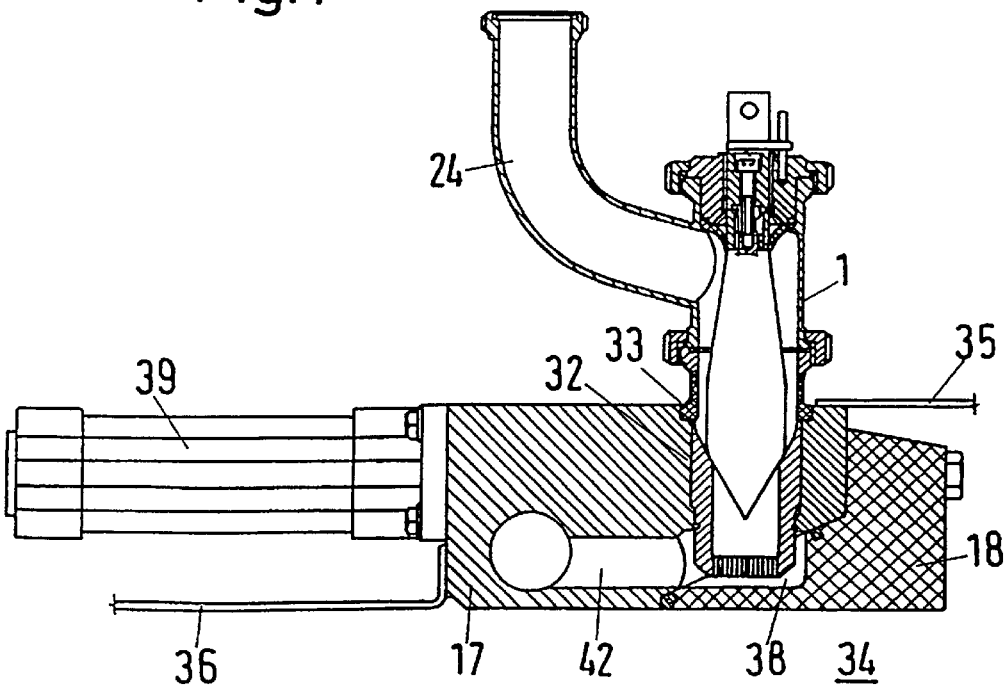
Figure 5:
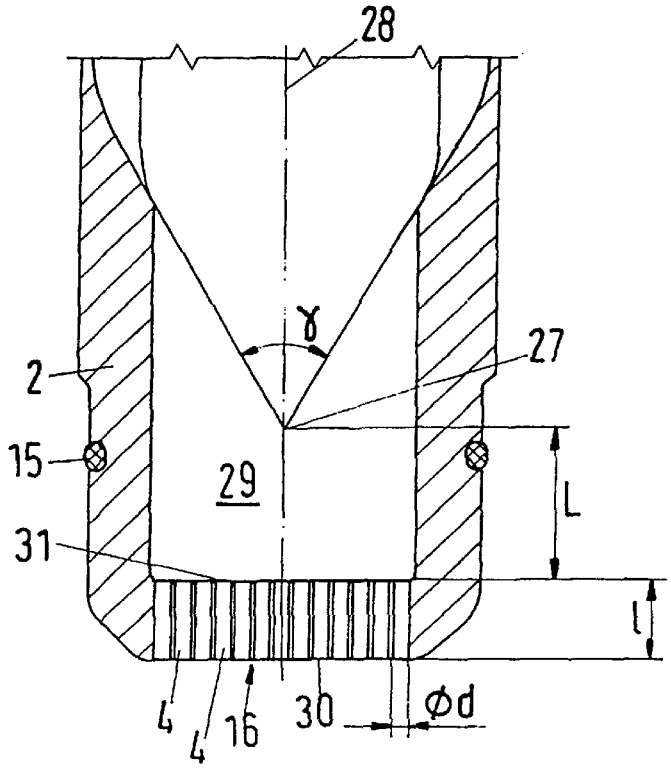
Figure 6:
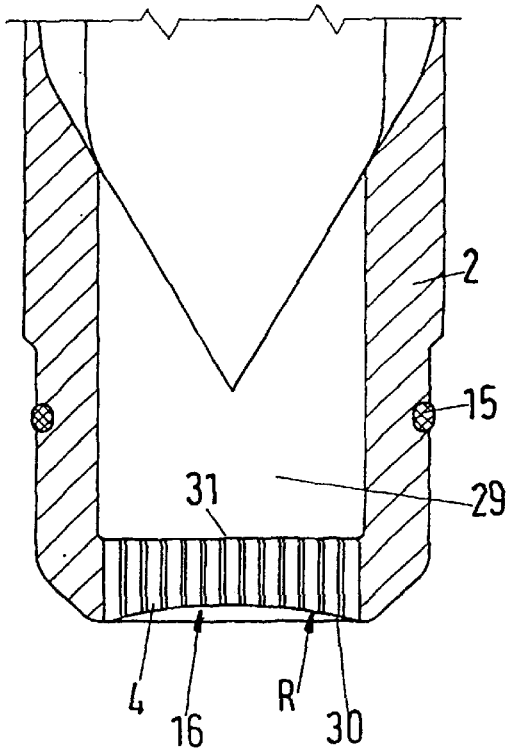
Figure 7:
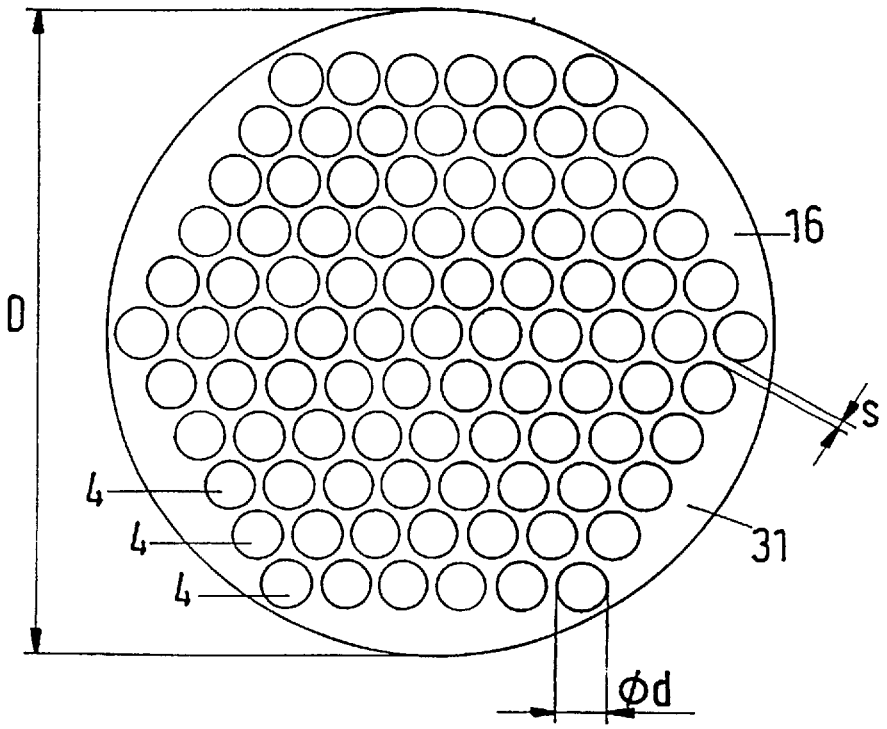
Figure 8:
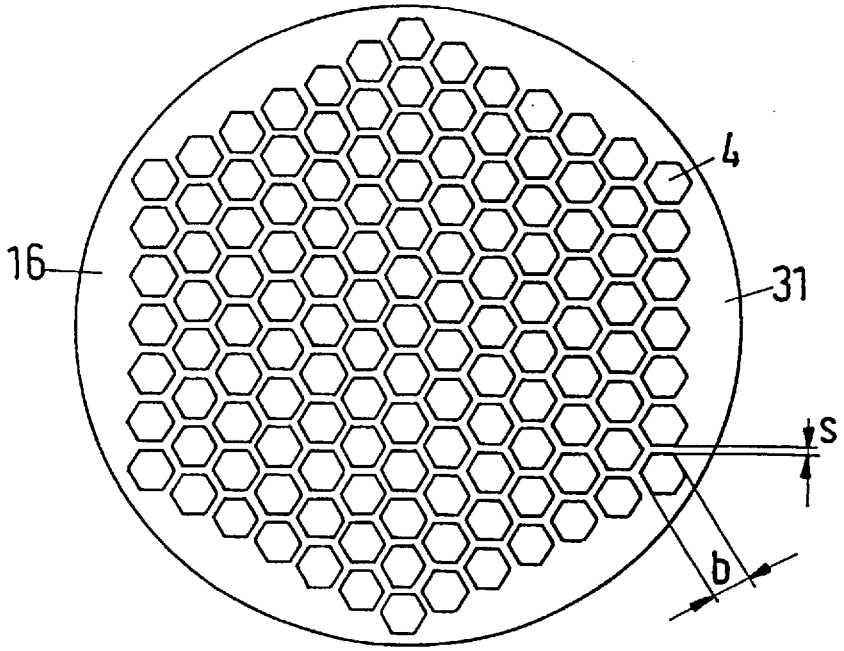

Further advantages, features and possibilities for use of the present invention will be found in the following description of a preferred embodiment with reference to the drawings. In these is shown in:

FIG. 1 a perspective view of the new filler valve without tubing and without the carrier plate, in the closed position, shown with the housing cut away for clarity, FIG. 2 a vertical cross-sectional view through the filler valve constructed according to FIG. 1, FIG. 3 the same filler valve shown smaller and retained in a carrier plate with a cleaning cap moved away from it, in the filling position, FIG. 4 the same view as FIG. 3, in which, however, the cleaning cap is brought onto the carrier plate into the position for the cleaning, FIG. 5 an enlarged part cross-section view through the mouth piece with the cone of the closing body arranged inside it, FIG. 6 the same view as FIG. 5, in which, however, the outlet plate is configured to be downwardly curved, FIG. 7 the plan view of the outlet plate from inside in the direction of the longitudinal axis of the mouthpiece in a first embodiment with circular outlet holes, and FIG. 8 the same view as in FIG. 7, however with outlet holes with a polygonal cross-section.

The filler valve shown respectively in perspective and in cross-section in FIGS. 1 and 2 is provided in its upper half with a housing 1 and fitted thereto in the lower half a mouthpiece 2, in the centre of which an externally streamlined closing member 3 is arranged, moveable upwards and downwards vertically in the direction of the double arrow 26. A supply pipe 24 opens out laterally, via a vertical component, at the top of the housing 1, where the upper, rear part of the closing part of the closing member 3 is located, and is sealed by means of a membrane 5 made from rubber or silicon. In the lower area the mouth piece 2 is closed by the outlet plate 16, the active surface of which, particularly visible in FIGS. 7 and 8, is provided with as many outlet holes 4 as possible.

At the rear end, the closing member 3 is provided with a projection 21, in which a feather key 6 is seated, which protects an arbor 8 in a groove which is not shown from twisting. The arbor 8 can be tightly screwed onto the projection 21 of the closing member 3 with a screw 9. The fork head 20 which is configured integrally with the arbor 8 is also fastened thereby. A plain bearing sleeve 10 is located around the top part of the screw 9 around the arbor 8 and provides for a sliding movement of the arbor 8 in the bore of a cover 7. The cover 7 is screwed to the housing 1 with a nut 11. A nut 12 of the same type joins the housing 1 to the mouth piece 2, wherein an O-ring 13 is clamped between them, the seating of which is designed according to aseptic considerations. In this way the housing 1 and the mouth piece 2 are joined together in a sealed manner.

In order to prevent twisting of the membrane 5 and thereby any possible damage, the arbor 8 is secured against twisting by means of a cylindrical pin 14. On the external surface of the mouthpiece 2 in the lower area (bottom third adjacent to the outlet plate 16) an O-ring 15 is located which seals the valve from the hygienic space or sterile area of the filling machine.

The assembly is designed so that the arbor 8 is inserted above the plain bearing sleeve 10 from above to below into the cover 7. The closing member 3 is then inserted upwards with the turned-up, rotationally symmetrical, cup-shaped membrane 5, wherein the feather key 6 is then already inserted in the groove. The projection 21 at the rear end of the closing member 3 now projects upwards into a corresponding central cut-out in the arbor 8, and is screwed tight by the screw 9. After this, the cover 7 is lowered with the closing member 3 located beneath it, into the housing 1 onto which the mouth piece 2 is not yet fitted. With the screwing using the union nut 11, the membrane 5 could twist and so the inside of the housing can be seen from below and it can be checked whether the membrane 5 is correctly placed. If the membrane 5 is seated precisely and in the desired position, the mouth piece 2 is then screwed on from the bottom. The air above and at the rear, behind the membrane 5 can disperse upwards through gaps in the plain bearing sleeve 10 which are not shown, so that there can be no vacuum or high pressure in the space behind the membrane 5. At the forward, lower end, the closing member, streamlined as a whole, is configured as a cone, the tip of which can clearly be seen in FIGS. 1 to 6. Towards the rear and the top the cone terminates in a cylindrical walled part, and the transitional surface of the closing member 3 going towards its bottom point 27 is tightly engaged with the valve seat 23.

FIGS. 1, 2 and 5 to 8 show particularly clearly the configuration of the outlet plate 16. This is directed in the outflow direction, that is to say in the direction of the longitudinal axis 28 of the mouth piece 2 and also of the housing 1 horizontally downwards (lower direction of the double arrow 21). The outlet holes 4 all run in this direction and lie parallel to one another. They are regularly distributed over the whole cross-section of the mouth piece 2, as can be seen in FIGS. 7 and 8. The diameter of the circular cross-section outlet holes 4 is labelled d in FIG. 7. Correspondingly, the width of the hexagonal cross-section outlet holes 4 is labelled b in FIG. 8. Between the respective outlet holes 4 there remain small webs, which are labelled s in FIGS. 7 and 8. In practice, 0.1 mm<s<0.5 mm, wherein s=0.3 mm for the case where the circular outlet holes is preferred. The diameter d and the width b should be greater than 1 mm and less than 5 mm. In practice, a dimension of 2 mm has proved very advantageous.

The diameter D of the inside space 29 of the mouth piece 2 should be only 5 to 10% larger than the diameter of the in-fill opening in the package to be filled, which is not shown. It will be recognised nevertheless that the external diameter of the mouth piece 2 would in such a case be larger than the in-fill opening of the package, and as a result the mouth piece 2 could not be introduced into the in-fill opening of a package. According to the invention, however, this is neither intended nor necessary, and the advantage will be recognised as having the large cross-section surface of the outflow stream of the product to be filled in compared to a pipe dimension of a known valve, which is not shown, which would have a smaller effective active surface or active outlet area just so that the mouth piece could be inserted in the in-fill opening of the package. The advantages according to the invention are obvious.

In the embodiment according to FIG. 6, the external surface 30 of the outlet plate 16 facing away from the flow is curved in a concave manner so that the central outlet holes 4 are clearly shorter by approximately 15% than the outer ones.

The closing member 3 is configured as a cone with its tip 27 and the cone angle γ of approximately 60°. The distance L of the cone tip 27 of the closing member 3 to the outflow side internal surface 31 of the outlet plate 16 (which is viewed in FIGS. 7 and 8) should be greater than D/2, that is greater than half the diameter of the internal space 29 of the mouth piece 2.

The thickness of the outlet plate 16 is the same as the length 1 of the outlet holes 4. The correct flow behaviour is obtained when the length 1>2d, or >2b, that is to say greater than double its diameter d or width b. With this, 1 mm<d<5 mm and 1 mm<b<5 mm. With a preferred embodiment described by way of an example, 1=5d, where d=2 mm.

FIGS. 3 and 4 show that the mouth piece 2 is kept releasably inserted in a matchingly shaped recess 32 in a carrier plate 17. In addition to the bottom sealing ring 15, this plug-in connection is also sealed by means of the upper sealing ring 33 (FIGS. 3, 4), so that a double security is provided against any air entering from the surroundings, by means of which bacteria could be imported into the hygienic space which is labelled 34 in FIGS. 3 and 4. In addition to the carrier plate 17 with the cleaning cap 18 moveably arranged with respect thereto, at the top right a separating plate 35 and at the bottom left a further separating plate 36 separates the hygiene space 34 found underneath from the surroundings which must be envisaged above. Facing downwards towards the hygienic space 34, the carrier plate is provided with a planar, downstream, external surface 37 inclined at 30° to the longitudinal axis 28, which corresponds to the inclined surface, which is not described in more detail, of the cleaning cap 18 in position and in inclination. In addition, a clearance space 38 is made in the inclined surface of the cleaning cap 18, which can receive the bottom end of the mouth piece 2, which projects from the inclined surface 37 of the carrier plate. If the cleaning cap 18 is moved horizontally to the left in the direction of the arrow 41 by means of the pneumatic cylinder 39 using the guide 40, from the position in FIG. 3 into the position in FIG. 4, the clearance space 38 is closed in the manner of a cleaning space, onto which the line 42 in the carrier plate 17 connects. For sealing, an annular seal 43 is set into the inclined surface of the cleaning cap 18, surrounding the clearance space 38.

FIG. 3 shows the filling operation of the cleaning cap 18.

Filling operation

At the beginning of the filling procedure, the liquid is in the internal space 29 of the valve as far as the sealing surface, that is to say as far as the seat 23 between the closing member 3 and mouth piece 2. As the valve is closed in the direction of flow, the membrane 5 is stretched downwards, so that no pockets form in which air can collect. In addition, the supply line 24 has a slope with a vertical component so that any locked in air can rise to the top. By means of the movement of the closing member 3 upwards, the annular gap between the seat 23 on the mouth piece 2 and the closing member 3 is released, through which the liquid in the space 29 can flow under the closing member 3 and from there through the outlet holes located at the bottom end. The tip 27 of the cone of the closing body 3 is located far enough above the internal surface 31 of the outlet plate 16 on the outflow side, so that the stream of liquid has again been cleaned and calmed before entering the outlet holes 4. To terminate the filling procedure, the closing body 3 is moved downwards until it again forms a sealing contact with the seat 23. After the initial filling, the liquid is retained in the space under the closing body 3 by atmospheric pressure and the surface tension of the liquid when there are sufficiently small outlet bores 4, so that dripping is prevented. The diameter of the stream combined from the individual streams, which is not shown, is smaller than that of the outlet cross-section D at the mouth piece. In this way the opening cross-section of the package can be better employed than with known filler valves in which the mouth piece has to dip into the package.

Cleaning

The cleaning cap 18 is moved from the position in FIG. 3 to that shown in FIG. 4 in the direction of the arrow 41 such that the internal cleaning space 38 is sealed off with the aid of the sealing ring 46 with respect to the hygienic space 34. Cleaning preparations can now be fed into the supply connection piece 24, flows around the closing body 3 which is in the open position, that is to say is raised from the seat 23, flows into the internal space 29 in the mouthpiece 2 and leaves it via the outlet holes 4. Because they lie inside the internal cleaning space 38, even the external surfaces of the mouthpiece 2 projecting from the inclined surface 37 of the carrier plate 17 into the hygienic space 34 are rinsed with the cleaning preparation, which is then fed back through the line 42. After cleaning is finished, the cleaning cap needs only to be returned to the position in FIG. 3 by activation of the pneumatic cylinder 39, and the filling operation can begin again.

List of designations

| | |
|---|---|
| 1 | housing |
| 2 | mouth piece |
| 3 | closing member |
| 4 | outlet holes |
| 5 | diaphragm |
| 6 | feather key |
| 7 | cover |
| 8 | arbor |
| 9 | screw |
| 10 | plain bearing sleeve |
| 11 | nut |
| 12 | nut |
| 13 | O-ring |
| 14 | cylindrical pin |
| 15 | O-ring |
| 16 | outlet plate |
| 17 | carrier plate |
| 18 | cleaning cap |
| 20 | fork head |
| 21 | projection |
| 23 | valve seat |
| 24 | supply connection piece |
| 26 | double arrow |
| 27 | tip |
| 28 | longitudinal axis |
| 29 | internal space |
| 30 | external surface |
| 31 | internal surface |
| 32 | recess |
| 33 | sealing ring |

-continued

| List of designations | |
|---|---|
| 34 | hygienic space |
| 35 | separating plate |
| 36 | separating plate |
| 37 | external surface |
| 38 | free space |
| 39 | pneumatic cylinder |
| 40 | guide |
| 41 | arrow |
| 42 | line |
| 43 | annular seal |
| 46 | sealing ring |

We claim:

1. A valve for filling liquids into packages, with a housing with a supply connection piece at a rear of the housing, a forward mouth piece and an outlet device in which a large number of outlet holes is arranged, with a closing member movably arranged in the housing which can be engaged with the valve seating and with sealing devices arranged at the rears whereby the outlet holes are distributed over the whole cross-section of the mouth piece and are arranged in an outlet plate and penetrate it in the direction of the longitudinal axis of the mouth piece, wherein said outlet plate is configured integrally with the mouth piece such that the mouth piece downstream of a connecting thereof to the housing is shaped integrally as one piece having a continuous surface, and that the diameter and width of the outlet holes is greater than 1 mm and less than 5 mm, and that the length of the outlet holes is greater than twice their diameter or width.

2. A valve according to claim 1, wherein the cross-section of the outlet holes is circular.

3. A valve according to claim 1, wherein the cross-section of the outlet holes is polygonal.

4. A valve according to claim 1, wherein the downstream external surface of the outlet plate is concave.

5. A valve according to claim 1, wherein the closing body is configured on the downstream side as a cone, the cone angle (γ) of which is in the region of 40° to 90°.

6. A valve according to claim 1, wherein the closing body comprises a cone and in that the distance of the tip of the cone of the closing body from the internal surface of the outlet plate facing upstream is greater than the half diameter of the mouth piece.

7. A valve according to claim 1, wherein the valve is used to fill liquids in an aseptic manner into packages arranged in a hygienic space, in that the mouthpiece is kept inserted in a releasable manner in a suitably shaped recess in a carrier by means of seals such that essentially only the external surface of the mouthpiece around the outlet plate protrude from the carrier plate into the hygienic space.

8. A valve according to claim 1, wherein a cleaning cap is moveably arranged fixed in a guide device mounted in the carrier plate, which has a sealing surface with sealing means facing the carrier plate, wherein the sealing surface of the cleaning cap is configured to appropriately match the corresponding surfaces of the carrier plate and of the mouthpiece projecting therefrom in order to contain and form an integral cleaning space.

9. A valve according to claim 5, wherein the cone angle (γ) is in the region of 60° to 70°.

10. A valve according to claim 1, wherein the closing member from a downstream forward end thereof up to an upstream rear end thereof is defined without sharp edges and with gentle blending with a slight curve.

* * * * *